US010106989B2

(12) United States Patent
Calmes

(10) Patent No.: US 10,106,989 B2
(45) Date of Patent: Oct. 23, 2018

(54) APPARATUS FOR SETTING OBJECTS

(71) Applicant: Advanced Formliners, LLC, Onalaska, WI (US)

(72) Inventor: Shane Calmes, Onalaska, WI (US)

(73) Assignee: Advanced Formliners, LLC, Onalaska, WI (US)

( * ) Notice: Subject to any disclaimer, the term of this patent is extended or adjusted under 35 U.S.C. 154(b) by 0 days.

(21) Appl. No.: 15/687,746

(22) Filed: Aug. 28, 2017

(65) Prior Publication Data

US 2017/0356191 A1 Dec. 14, 2017

Related U.S. Application Data

(63) Continuation of application No. 14/213,284, filed on Mar. 14, 2014, now abandoned.

(60) Provisional application No. 61/783,821, filed on Mar. 14, 2013.

(51) Int. Cl.
*E04F 13/14* (2006.01)

(52) U.S. Cl.
CPC ..... *E04F 13/147* (2013.01)

(58) Field of Classification Search
CPC ..... E04F 13/47
USPC ..... 52/747.11, 747.12
See application file for complete search history.

(56) References Cited

U.S. PATENT DOCUMENTS 636,200 A 10/1899 Frink
777,656 A 12/1904 Banning
1,564,578 A 12/1925 Kennedy
1,809,504 A 6/1931 Carvel
1,896,188 A 2/1933 Shanklin
1,945,024 A 1/1934 Collet et al.
2,114,710 A 4/1938 Holcomb
2,465,871 A 3/1949 Hardie et al.
2,627,100 A 2/1953 Jelks
2,654,935 A 10/1953 Ager
2,858,247 A 10/1958 Swart
2,876,927 A 3/1959 Henning
2,887,756 A 5/1959 Brechel
2,964,800 A 12/1960 Dorsett
2,974,716 A 3/1961 Fourness
3,349,158 A 10/1967 Maynard
3,382,640 A 5/1968 Thomas et al.
3,411,257 A 11/1968 Yaermchuk
(Continued)

FOREIGN PATENT DOCUMENTS

EP 0449584 10/1991
JP 03-082508 4/1991

*Primary Examiner* — Patrick J Maestri
(74) *Attorney, Agent, or Firm* — Vidas, Arrett & Steinkraus

(57) ABSTRACT

In at least one embodiment, a panel comprises a body portion comprising a front side, a back side and a plurality of cavities. The front side comprises a plurality of face portions and cavity openings arranged on a first plane, and a plurality of guide members. Each guide member comprises a front edge arranged on a second plane, wherein the second plane is offset from the first plane. The guide members define a plurality of spaces of predetermined volume between said first plane and said second plane. A method comprises providing the panel, applying mortar to the panel in the predetermined volumes, skimming the mortar using the guide members to guide an edge to form metered mortar pans, and pressing objects into the mortar pans.

19 Claims, 5 Drawing Sheets

(56) References Cited

U.S. PATENT DOCUMENTS 3,419,457 A 12/1968 Bieasdale
3,594,968 A 7/1971 Johnson
3,602,476 A 8/1971 Iragorri
3,783,087 A 1/1974 Vecchiarelli
3,801,405 A 4/1974 Corkery et al.
3,908,326 A 9/1975 Francis
4,011,702 A 3/1977 Matyas
4,052,825 A * 10/1977 Larsson ..... B28B 19/0053 52/392
4,133,481 A 1/1979 Bennett
4,239,824 A 12/1980 Kasten
4,393,108 A 7/1983 Barker et al.
4,695,033 A 9/1987 Imaeda et al.
4,858,410 A 8/1989 Goldman
4,859,511 A 8/1989 Patterson et al.
4,888,928 A 12/1989 Rea et al.
4,889,758 A 12/1989 Rinkewich
4,923,733 A 5/1990 Herbst
4,963,054 A 10/1990 Hayashi
5,002,817 A 3/1991 Jones
5,006,011 A 4/1991 Hiyashi
5,038,541 A 8/1991 Gibbar, Jr.
5,162,150 A 11/1992 Buis et al.
5,242,738 A 9/1993 Furuya et al.
5,268,137 A 12/1993 Scott et al.
5,268,213 A 12/1993 Murakami et al.
5,277,009 A 1/1994 Yamaguchi et al.
5,489,462 A 2/1996 Sieber
5,637,236 A 6/1997 Lowe
5,667,190 A 9/1997 Scott et al.
5,701,710 A 12/1997 Tremelling
5,787,667 A 8/1998 Sheahan et al.
5,822,937 A 10/1998 Mahony et al.
5,887,846 A 3/1999 Hupp
5,900,180 A 5/1999 Scott et al.
6,024,339 A 2/2000 Gates
6,041,567 A 3/2000 Passeno
6,059,257 A 5/2000 Scott, III
6,127,020 A 10/2000 Bacon, Jr. et al.
6,164,037 A 12/2000 Passeno
6,335,073 B1 1/2002 Kock et al.
6,408,585 B1 6/2002 Tajima
D479,614 S 9/2003 Scott et al.
6,857,248 B2 2/2005 Ouellet et al.
7,658,050 B2 2/2010 Bouchard et al.
7,871,054 B2 1/2011 Walters
7,896,309 B1 3/2011 DiGiammo
7,963,499 B2 6/2011 Fitzgerald et al.
8,074,957 B2 6/2011 Fitzgerald et al.
D648,450 S 11/2011 Drummond
8,181,930 B2 5/2012 Fasching et al.
D674,517 S 1/2013 Scott, III
D704,865 S 5/2014 Calmes
8,888,067 B1 11/2014 Calmes
2002/0106504 A1 8/2002 Stott
2004/0200168 A1 10/2004 Takagi et al.
2004/0226230 A1 11/2004 Ritzer
2005/0064128 A1 3/2005 Lane et al.
2005/0097827 A1 5/2005 Jordan
2006/0091282 A1 5/2006 Walters
2006/0131475 A1 6/2006 Testa
2006/0157634 A1 7/2006 Nasvik
2006/0180731 A1 8/2006 Scott et al.
2007/0151184 A1 7/2007 Wise et al.
2007/0209308 A1 9/2007 Barrett
2007/0217865 A1 9/2007 Castonguay et al.
2008/0092473 A1 4/2008 Heyns
2009/0100774 A1 4/2009 Fasching et al.
2010/0071308 A1 3/2010 Fitzgerald et al.
2010/0155569 A1 6/2010 Walters et al.
2010/0314527 A1 12/2010 Fitzgerald et al.
2012/0074604 A1 3/2012 Calmes
2014/0053487 A1* 2/2014 Tatari ..... E04F 13/09 52/386

* cited by examiner

APPARATUS FOR SETTING OBJECTS

CROSS-REFERENCE TO RELATED APPLICATIONS

This application is a continuation of U.S. patent application Ser. No. 14/213,284, filed Mar. 14, 2017, which claims the benefit of U.S. Provisional Application No. 61/783,821, filed Mar. 14, 2013, the entire disclosures of which are hereby incorporated herein by reference.

FIELD OF THE INVENTION

The present invention relates generally to a layout panel suitable for supporting and position objects, such as building materials, bricks, tile and the like. The invention also relates to walls comprising a layout panel.

BACKGROUND OF THE INVENTION

Thin brick systems are often used as a decorative element to a new or existing architectural structure. A thin brick is typically a kiln-dried brick unit having height and width dimensions similar to those dimensions of conventional brick, but having a relatively small depth/thickness. Thin brick systems give structures the appearance of having full brick walls while avoiding the associated expense.

Thin brick objects can be applied to a wall using traditional mortar. Alternatively, they may be applied using a quick drying glue followed by an application of mortar or grout between the thin bricks. Either of these methods is labor intensive.

An alternative method for installing thin bricks is to use keyed bricks which have a recess cut into the back side of the brick. Keyed bricks are mounted onto a support panel that has tabs for engaging the recess at the back of the brick. Grout is then applied to the gaps between the bricks to give a finished look and secure the bricks in place. A problem with the keyed brick system is that applying the grout is labor intensive. Also, the support panel is often made of metal and susceptible to corrosion, denting, etc.

Tiles typically have a glazed front surface and usually are installed by applying a layer of thin set mortar onto the underlying structural surface, pressing the tiles into the thin set mortar. After the mortar sets, grout is applied overtop of the tiles, and excess grout is wiped off the front surface of the tile. This method of setting tiles is labor intensive. Further, the particular method of applying grout and wiping the tile surface clean does not work for porous objects, such as thin brick, because the grout cannot easily be wiped off of the front surface of a porous object.

There remains a need for inventive devices and methods to ease masonry, tiling and wall building operations.

Without limiting the scope of the invention a brief summary of some of the claimed embodiments of the invention is set forth below. Additional details of the summarized embodiments of the invention and/or additional embodiments of the invention may be found in the Detailed Description of the Invention below.

All US patents and applications and all other published documents mentioned anywhere in this application are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a panel comprises a body portion comprising a front side, a back side and a plurality of cavities. The front side comprises a plurality of face portions and cavity openings arranged on a first plane, and a plurality of guide members. Each guide member comprises a front edge arranged on a second plane, wherein the second plane is offset from the first plane. The guide members define a plurality of spaces of predetermined volume between said first plane and said second plane.

In at least one embodiment, a panel comprises a body portion comprising a front side, a back side and a plurality of cavities. The front side comprises a plurality of face portions and cavity openings arranged on a first plane. The front side further comprises a plurality of guide members oriented parallel to one another, each guide member comprising a front edge arranged on a second plane. The second plane is offset from and parallel to the first plane. Each cavity opening is in communication with a cavity. Each cavity is larger than its cavity opening. A plurality of the cavities have a similar size and shape. The guide members define a plurality of spaces of predetermined volume between said first plane and said second plane.

In some embodiments, an object of the present invention to provide an improved support panel that speeds installation of hand laid masonry and tile. Another object of the invention is to provide good adhesion for thin brick. Yet another object of the present invention is to provide a support panel that is relatively simple to manufacture, easy to use, and cost effective.

In some embodiments, a wall comprises a layout panel, wherein the layout panel comprises any suitable combination of features including a sheathing, a vapor barrier, a weep channel and/or a lath.

In some embodiments, the present invention is directed to an apparatus for orienting and mounting objects, such as face elements or other building blocks, onto a surface such as a wall. Among the many different embodiments within the scope of the invention, some embodiments of a support panel comprise a plurality of guide members that extend from a front surface of the support panel. Some embodiments comprise a plurality of channels that open onto the front face of the support panel. Some embodiments of a support panel comprise ribs on the back face of the support panel for embedding the panel in a foam wall or pre-set concrete panel of an existing structure.

In at least one embodiment, the support panel is made of fiberglass. In some embodiments the support panel is formed from a corrugated sheet of fiberglass wherein the ribs are formed by the obverse side of the channels.

In some embodiments, a layout panel comprises a base portion and at least one guide member that is attachable to the base portion. A guide member can be attached to a layout panel having any suitable orientation, for example being horizontally oriented, vertically oriented or diagonally oriented.

The invention is also directed to methods of making and using the support panel.

In some embodiments, a method comprises providing a support panel having a plurality of substantially parallel guide members extending from a front face of the support panel, each guide member having a height defined by a top edge most distant from the front face of the support panel, wherein the top edge of each guide member is aligned on a common plane. Mortar is applied to the support panel in a quantity sufficient to form a metered volume of mortar that extends to said common plane. Objects are pressed into the mortar, wherein mortar is displaced to form joints between said objects.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention. Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

While this invention may be embodied in many different forms, there are described in detail herein specific embodiments of the invention. This description is an exemplification of the principles of the invention and is not intended to limit the invention to the particular embodiments illustrated.

Figure 1:
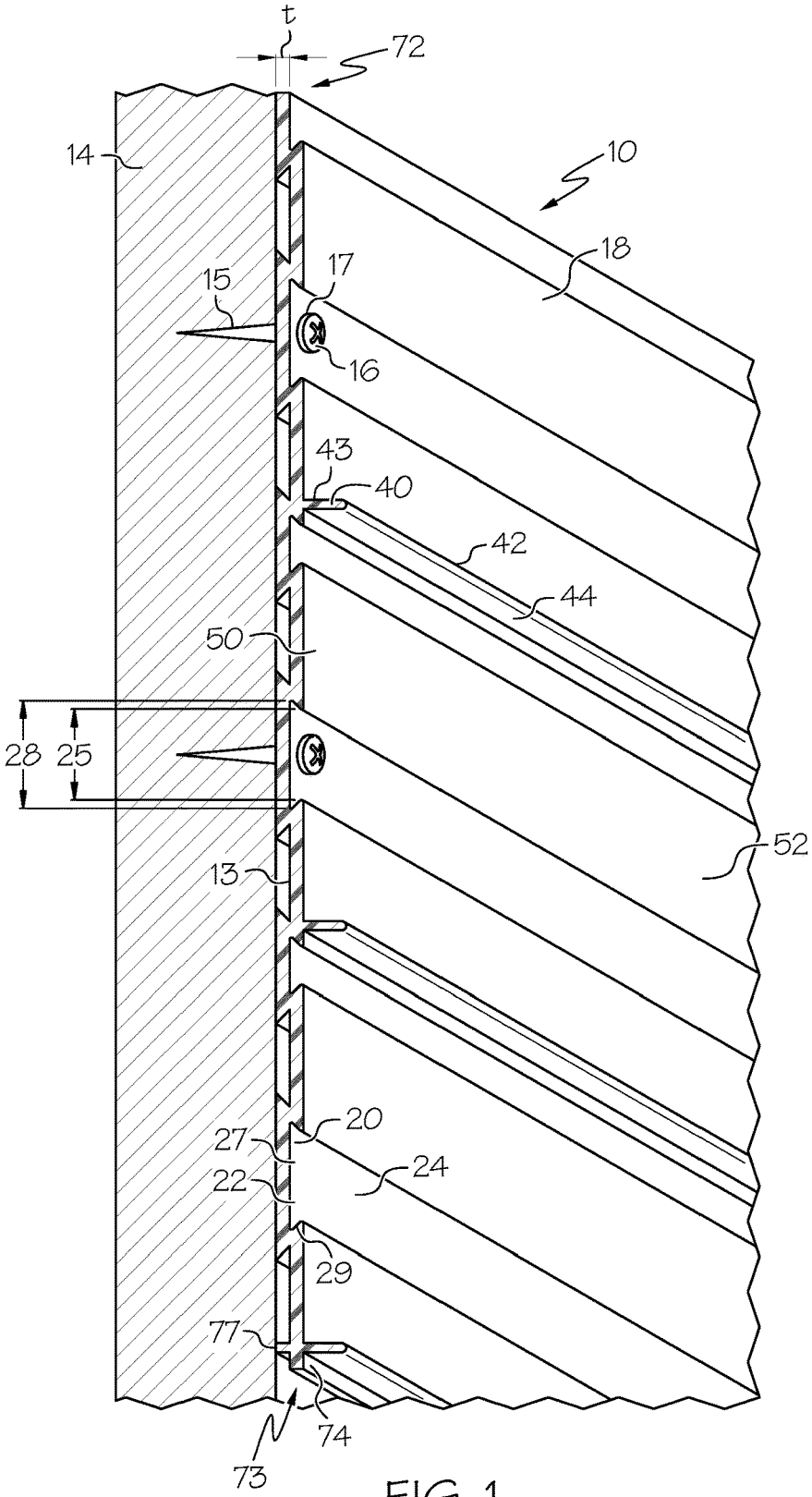
FIG. 1 is a perspective view of one example of a support panel attached to a structural wall.

Referring to the figures, FIG. 1 generally depicts an example of a support panel 10. In some embodiments, a support panel 10 comprises one or more cavities 20 arranged to provide a lath for grout and mortar. In some embodiments, a support panel 10 comprises one or more guide members 40. In various embodiments, guide members 40 can have any suitable orientation, for example being arranged horizontally, vertically and/or diagonally. As shown in FIG. 1, the support panel 10 comprises guide members 40 arranged horizontally and parallel to one another. Each guide member 40 comprises a guide for laying out objects being attached to the panel 10, such as brick or tile. Guide members 40 that are oriented horizontally can provide a shelf for objects, as discussed herein.

As shown in FIG. 1, support panel 10 is configured to be mounted onto a supporting structure 14, such as a stud, column or other wall panel. For purposes of this disclosure, the orientation of support panel 10 is referenced as though support panel 10 is attached to a vertically extending supporting structure 14 such as a stud.

A support panel 10 can have any suitable orientation with respect to the supporting structure 14. In some embodiments, a height dimension of the support panel 10 is perpendicular to the ground when the panel is mounted on a vertical wall. Similarly, the width dimension of support panel 10 is parallel to the ground when the panel is mounted on a vertical support. The depth dimension of the support panel 10 is orthogonal to the width and height dimensions of support panel 10.

Desirably, a panel 10 comprises a plurality of cavities 20. In some embodiments, a cavity 20 comprises an elongate shape and is referred to herein as a locking channel. In some embodiments, a cross-sectional shape of a cavity 20 is constant along the length of the cavity 20.

In some embodiments, locking channels 20 extend horizontally. In some embodiments, locking channels 20 are oriented vertically.

In some embodiments, guide members 40 are formed integrally with the support panel 10. In some embodiments, guide members 40 are separate and are attachable to a base portion of the support panel 10.

Support panel 10 is made from any material suitable for use in building construction. In some embodiments, support panel 10 is made of fiberglass. In other embodiments, support panel 10 is made of other suitable materials such as metal, suitable polymers, beaded or extruded polystyrene foam products, etc., and various combinations thereof.

Support panel 10 is constructed to accommodate any suitable object 30 (FIG. 3) that can be attached to the panel 10. In at least one embodiment, support panel 10 is constructed to accommodate standard thin brick units. In other embodiments, support panel 10 is constructed to support any other suitable objects 30 (FIG. 3), such as facing elements made from stone, tile, wood, and the like.

In at least one embodiment, support panel 10 is formed of fiberglass. In some embodiments, a panel is formed using a process of pultrusion. Fiberglass is strong enough to be used as sheathing material and can be attached directly to the studs of an existing structural wall. Fiberglass provides a sufficient vapor barrier between opposite sides of the support panel 10 (e.g. between objects 30 (FIG. 3) and the supporting structural wall 14), eliminating the need to apply a separate vapor barrier to the building. Fiberglass has a coefficient of expansion similar to that of clay brick and cement mortar, so thermal stresses due to temperature variation will be minimized. Fiberglass is also insect resistant, does not rust or rot, does not block signals from mobile devices, is light weight, does not deform substantially under impact, is non-conductive, and is dimensionally stable.

Support panel 10, while illustrated as generally comprising a "sheet" of material, may be formed into any shape or size and may have any suitable thickness. In at least one embodiment, support panel 10 is approximately 8" tall and comprises any suitable width. When the panel 10 is pultruded or extruded, the width of the sheet can be easily varied. Different embodiments can be provided at standard building industry sizes, such as 8 feet, 12 feet, etc. The specific height of the panel 10 can depend upon the size and desired coursing of objects installed upon the guide members 40. For example, in many brick applications, an 8" tall panel 10 can provide three guide members 40 spaced at approximately 2.667" (on center). Any suitable guide member 40 spacing can be used depending upon the specifics of the objects (e.g. tile, brick) mounted to the panel 10. In some embodiments, support panels 10 are sized similarly to other standard building materials, such as comprising a 4 foot by 8 foot panel.

In some embodiments, the panels 10 can be applied to a wall in a manner similar to residential siding, wherein a plurality of panels 10 of a predetermined length are provided, and the panels 10 can be cut to length according to the requirements of the wall (e.g. according to wall length and necessary openings in the wall, such as openings for doors, windows, etc.). Desirably, the panels 10 can be cut with a saw, such as a circular or reciprocating saw.

In some embodiments, the upper and lower portions of a panel 10 are configured such that multiple examples of a given panel 10 interlock, wherein a lower edge of an upper panel interlocks with an upper edge of a lower panel. In some embodiments, a first interlocking edge 72 is arranged to interlock with a second interlocking edge 73. The first interlocking edge 72 can be arranged to abut the wall 14 and extends out from the wall a predetermined distance, such as a thickness dimension t of the panel 10. In some embodiments, the second interlocking edge 73 comprises a flange 74 that is spaced from the wall 14, thus defining a pocket 77. Desirably, the pocket 77 is sized to receive the first interlocking edge 72 of another panel 10, having a depth equal to or slightly greater than the dimension of the first interlocking edge 72 (for example the thickness t of the panel 10). The first interlocking edge 72 of one panel 10 can fit into the pocket 77 defined by the second interlocking edge 73 of another panel 10, wherein the lower panel 10 provides support for the upper panel, and the flange 74 of one panel helps to hold the other panel against the wall 14.

In some embodiments, support panel 10 comprises a plurality of transversely spaced locking channels 20. In some embodiments, locking channels 20 extend across a width of a support panel 10 (e.g. horizontally). In some embodiments, locking channels 20 extend across a height of a support panel 10 (e.g. vertically).

Desirably, cavities 20 provide a lath suitable for engaging grout or mortar. In some embodiments, each cavity 20 includes a cavity opening 24, which opens to front panel face 18 of the support panel 10. In some embodiments, a size of a cavity 20 is greater than a size of the cavity opening 24. For example, a distance across a cavity 20 is greater than a parallel distance across a cavity opening 24. This allows grout or mortar to enter the cavity 20, cure in the cavity 20 and become unable leave the cavity 20 by passing through the channel opening 24. As illustrated in FIG. 1, in some embodiments, a horizontally oriented locking channel 20 can enclose an internal cavity 22, which is defined by a bottom wall 27 and two side/lateral walls 29. In some embodiments, bottom wall 27 is flat and smooth. In other embodiments, bottom wall 27 may be curved and/or angular. Bottom wall 27 may have indentation(s) or may be smooth. Similarly, lateral walls 29 may be flat, curved, smooth, indented, or any combination thereof. In at least one embodiment, lateral walls 29 are flat and slant toward one another in the direction of channel opening 24, thereby defining an internal cavity 22 that is tapered. In some embodiments, a tapered geometry of walls of the locking channel 20 creates a mechanical lock that retains mortar 19 (FIG. 2) as will be described below.

In some embodiments, support panel 10 is attached to an existing structural support 14 by any suitable fastener 15 such as, for example, a screw. In at least one embodiment, support panel 10 is attached to a structural support 14 by passing fastener 15 through a pre-existing hole 17 formed in support panel 10. In some embodiments, a washer 16 is used to help prevent fastener 15 from pulling through support panel 10. In some embodiments, pre-existing hole 17 is located at the bottom wall 27 of locking channels 20.

In some embodiments, the cavity opening 24 of a locking channel 20 has a mouth span 25, which is defined by the distance separating the lateral walls 29 at the opening 24. Similarly, internal cavity 22 has a cavity span 28 defined as the distance separating the lateral walls 29 for a given depth above the bottom wall 27 of locking channels 20. In some embodiments, cavity span 28 will vary at different depths within internal cavity 22. In at least one embodiment, mouth span 25 will be smaller than cavity span 28 for at least one depth location within internal cavity 22. In such an embodiment, the shape of locking channels 20 is tapered and creates a mechanical lock by confining mortar 19 (FIG. 2), or a suitable adhesive, to internal cavity 22 after mortar 19 sets.

In some embodiments, support panel 10 comprises a plurality of rails 50. In some embodiments, rails 50 are located between locking channels 20, creating a corrugated panel construction. In some embodiments, rails 50 extend across the width of support panel 10. Rails 50 have a front rail face 52. In at least one embodiment, front rail face 52 is flat and co-planar with the front rail face 52 of the other rails 50. However, it is not necessary that the geometry of rails 50 be so limited. In some embodiments, front rail face 52 may not be co-planar with another front rail face 52. In some embodiments, front rail face 52 may be curved, smooth, indented, angled, or any combination thereof. In some embodiments, a front rail face 52 comprises a stepped surface, which can create a decorative stepped orientation in objects 30 that are attached to the front rail face 52.

In some embodiments, a front side of the support panel 10 comprises a plurality of face portions 52 and cavity openings 24 arranged on a first plane. In some embodiments, face portions 52 are planar.

In some embodiments, the support panel 10 comprises at least one guide member 40. A guide member 40 is desirably suitable for guiding the layout of objects 30 that will be attached to the panel 10.

In some embodiments, each guide member 40 comprises a front edge 42. In some embodiments, the front edge 42 of each guide member 40 is oriented on a second plane. Desirably, the second plane is offset from the first plane that includes face portions 52. In some embodiments, the second plane is parallel to the first plane.

In some embodiments, one or more guide members 40 extend across the width of support panel 10. In some embodiments, one or more guide members 40 extend across the height of support panel 10. In some embodiments, one or more guide members 40 extend diagonally across the support panel 10. In some embodiments, a support panel 10 comprises a plurality of guide members 40 that are parallel to one another. In some embodiments, a support panel 10 comprises a plurality of guide members 40 that are of similar size and shape.

In at least one embodiment, guide members 40 are integrally formed with support panel 10. In some embodiments, guide members 40 are attached to support panel 10 by any suitable means such as a fastener, a mortise and tenon coupling, a dovetail joint, an adhesive, any other suitable method or any combination thereof. In some embodiments, guide members 40 are passed through support panel 10 with a portion of guide members 40 being retained by the back panel face 13 of support panel 10. In some embodiments, guide members 40 are affixed to rails 50.

In some embodiments, the plurality of guide members 40 are substantially parallel with one another. FIG. 1 shows guide members 40 that are horizontal when panel 10 is affixed to a supporting structural wall 14. Guide members 40 are transversely spaced across support panel 10, and the spacing between adjacent guide members 40 is sufficient to accommodate objects 30 (FIG. 3) that are to be mounted onto support panel 10.

In some embodiments, guide members 40 are equally spaced at repeating intervals. In some embodiments, a spacing of the guide members 40 is equal to a height of a standard building object (such as a brick or tile) plus a height of a standard grout or mortar joint. In this way, guide members 40 can be used to lay out row coursings for the objects 30 mounted onto support panel 10. In some embodiments, guide members 40 comprise a shelf and provide support for objects 30, supporting objects 30 in place during the curing process of the material used to bond objects 30 to support panel 10.

In some embodiments, guide members 40 comprise a top lateral face 43 (FIG. 1) and a bottom lateral face 44. In some embodiments, top lateral face 43 is perpendicular with front panel face 18 of support panel 10. In other embodiments, top lateral face 43 may be angled upward or downward relative to the front panel face 18, for example to assist drainage of moisture away from support panel 10.

In some embodiments, top lateral face 43 and bottom lateral face 44 join one another directly, forming a top shelf edge 42, which is the portion of guide members 40 that is most distant from the supporting structure 14. In at least one embodiment, guide members 40 comprises a front face (not shown), which is interposed between top lateral face 43 and bottom lateral face 44. In some embodiments, a plurality of the top shelf edge 42 surfaces (or front faces) are aligned in a common plane.

Figure 2:
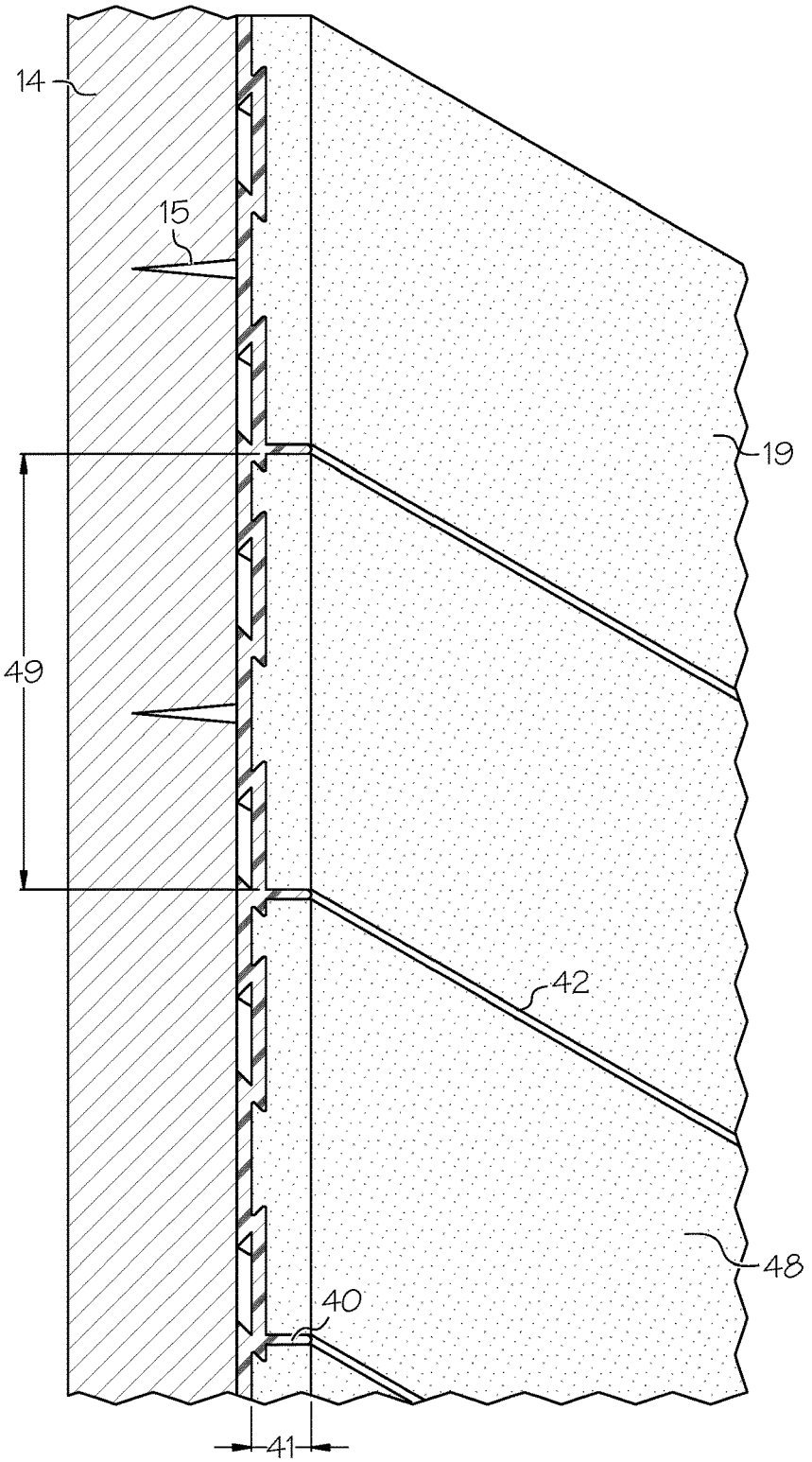
FIG. 2 is a perspective view of the embodiment depicted in FIG. 1 after mortar has been applied to and skimmed off the support panel.

Referring to FIG. 2, guide members 40 define a guide member depth 41, which is the distance from front panel face 18 to top shelf edge 42.

In some embodiments, guide members 40 serve as a mortar thickness gauge. In at least one embodiment, shelf depth 41 is selected to meter the appropriate volume of mortar 19 applied to support panel 10 before press mounting objects 30 (FIG. 3) onto support panel 10. In at least one embodiment, mortar 19 is applied to support panel 10 in sufficient quantity to form a substantially uniform layer that covers the top edge 42 of guide members 40. Excess mortar is then skimmed off of support panel 10 by using a straight-edged trowel (not shown) that is sufficiently long to extend across the top edge 42 of multiple guide members 40. In this way, an appropriate amount of mortar 19 is quickly laid at an exacting thickness defined by the shelf depth 41 of guide members 40.

A guide member 40 can provide for any suitable shelf depth 41. In various embodiments, the shelf depth (e.g. dimension guide member 40 extends outward from panel front face 52) can be provided at standard dimensions of ⅛", ¼", ⅜", ½", etc., or any suitable dimension therebetween. The shelf depth can also be less than ⅛" or greater than ½" as required by job specifics.

In FIG. 2, mortar 19 has been applied to support panel 10, and excess mortar has been skimmed off of panel 10 using a straight-edged trowel as described above. A mortar pan 48 is defined between adjacent guide members 40. Mortar pan 48 has a pan height 49 defined by the distance separating adjacent guide members 40. Pan height 49 determines the height of the bed joint 38 (FIG. 3), as will be discussed below.

Figure 3:
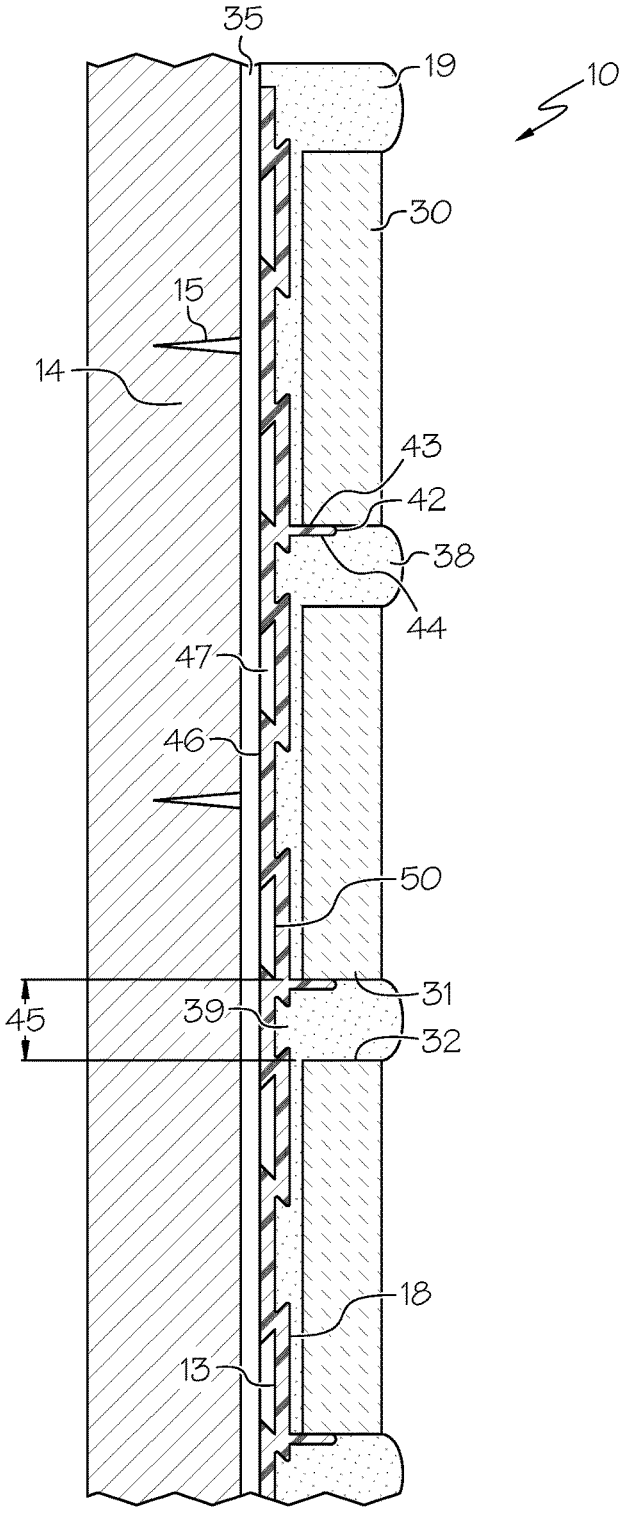
FIG. 3 is a side view of the embodiment depicted in FIG. 2 after thin bricks have been pressed into the mortar.

Referring to FIG. 3, objects 30 are shown after being pressed into the mortar pan 48. A method comprises affixing the support panel 10 to a support 14. Wet mortar 19 or other suitable curable compound is applied to support panel 10. A straight-edged trowel is skimmed over guide members 40 to remove any mortar 19 that extends beyond top shelf edge 42 of guide members 40, creating a mortar pan 48 having an appropriate, metered volume of mortar 19. Objects 30 are positioned so that bottom object edge 31 aligns with the top lateral face 43 of guide members 40. Objects 30 are pressed into mortar 19.

As objects 30 are pressed into mortar 19, mortar 19 is squeezed from the mortar pan 48 as the object 30 displaces the mortar 19. As a result, mortar 19 flows out around the perimeter edges of objects 30 and between adjacent objects 30. In some embodiments, pan height 49 (FIG. 2) is greater than the height of the objects 30 being used and desirably allows the mortar 19 to form a joint between the objects that resembles a traditional mortar joint in traditional masonry. In at least one embodiment, shelf depth 41 is less than the thickness of objects 30. In some embodiments, objects 30 are positioned on the top lateral face 43 of guide members 40. In this way, guide members 40 help align objects 30 and lay out row coursings for objects 30.

As objects 30 are aligned along guide members 40, a header space 39 will be formed between top object edge 32 of objects 30 and bottom lateral face 44 of adjacent guide members 40. As object 30 is pressed into mortar 19, header space 39 allows mortar 19 to flow and form bed joints 38 that conceal guide members 40. In some embodiments, guide members 40 partially support object 30 and hold object 30 in place while mortar 19 cures. In some embodiments, the resulting bed joints 38 can be struck to get rid of the excess mortar and give a desired look of traditional masonry.

In some embodiments, mortar 19 of bed joints 38 is adjacent to locking channels 20 positioned at least partially within the portion of support panel 10 that is overlapped by header space 39. In some embodiments, objects 30 are partially retained by locking channels 20 located within the portion of support panel 10 that is covered by objects 30. In at least one embodiment, mortar pan 48 comprises locking channels 20 positioned within space 39 and locking channels 20 positioned within the portion of support panel 10 that is covered by objects 30.

In some embodiments, support panel 10 comprises a plurality of rear channels 47 on the back panel face 13 of support panel 10. The rear channels 47 can allow the building to breathe and reduce the need for a separate air circulation system, when the rear channels 47 are left as air spaces.

In some embodiments, support panel 10 comprises a plurality of ribs 46 on the back panel face 13 of support panel 10. Ribs 46 are substantially parallel to locking channels 20 and are shaped to assist fixing support panel 10 to a supporting structural wall 14. In at least one embodiment, a foam layer 35 is used between the support 14 and the panel 10, and ribs 46 can embed into the foam layer 35.

In some embodiments, support panel 10 is mounted onto a structural wall 14 by embedding ribs 46 into a concrete layer before the concrete layer has set.

Figure 4:
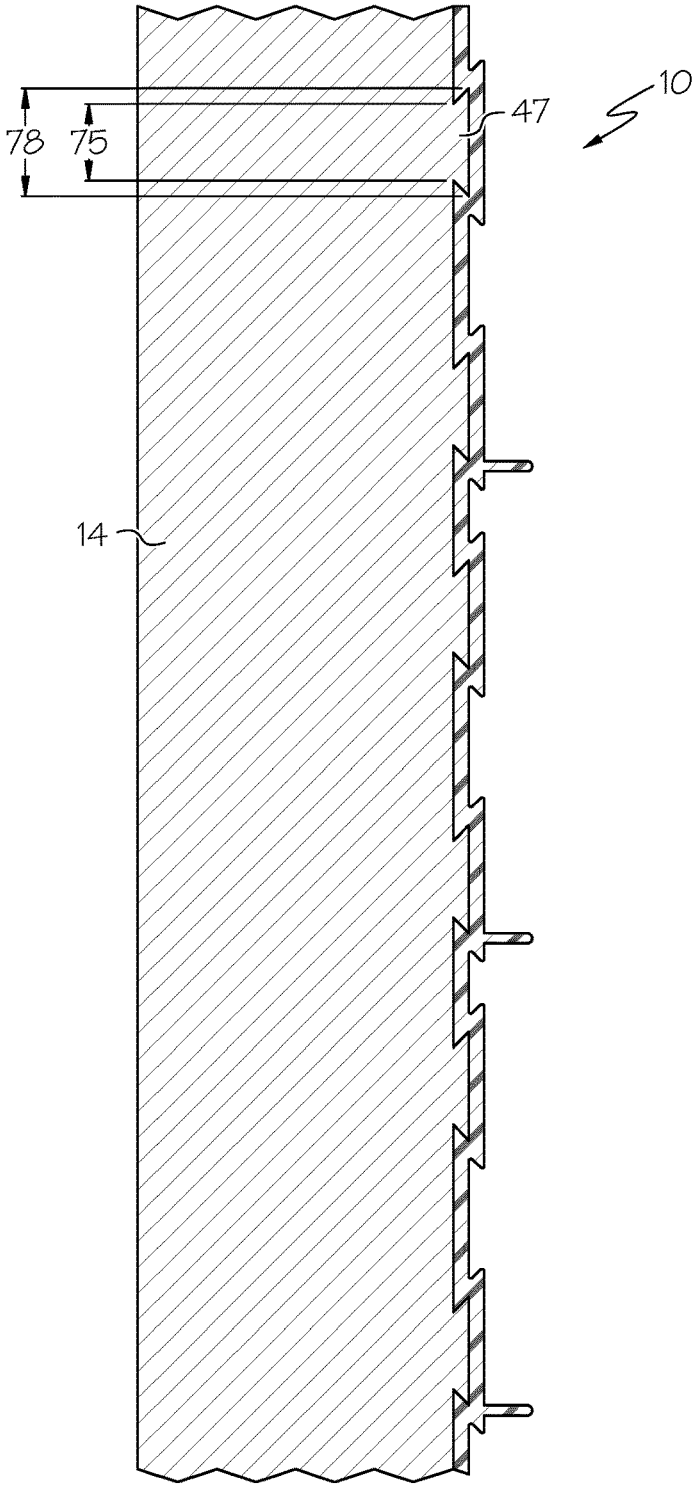
FIG. 4 shows a view of another embodiment of a support panel.

In some embodiments, the rear channels 47 can be used to secure the panel 10 to another material, such as a support 14 material, as illustrated in FIG. 4. For example, when a support 14 comprises concrete, the concrete can be allowed to flow into the channels 47 and cure. In some embodiments, a rear channel 47 comprises an opening that is smaller in dimension than a distance across the channel—for example, a rear channel 47 can have a mouth span 75 and a cavity span 78, wherein the cavity span 78 is greater than the mouth span 75. As shown in FIG. 4, this allows wall material 14 to form a mechanical lock with the channel 47, for example when a curable wall material is used.

In some embodiments, support panel 10 comprises edges that are constructed to mate with the edge of an adjacent support panel 10. In this way, support panel 10 can be joined to another support panel 10, creating the appearance of a continuous panel. In some embodiments, top and bottom edges of support panel 10 are constructed to join another support panel 10. In some embodiments, the side edges of support panel 10 are constructed to join the side edges of another support panel 10. In some embodiments, the edges of support panel 10 comprise tongue and groove joints. In at least one embodiment, support panel 10 has a flattened edge that slides under a raised edge of an adjacent support panel 10.

In some embodiments, support panel 10 has a plurality of drainage holes that allow moisture to drain away from support pane 10. In some embodiments, support panel 10 has drainage holes on rail 50 near the junction of rail 50 with guide member 40. In at least one embodiment, support panel 10 has drainage holes in a locking channel 20. In at least one embodiment, support panel 10 comprises drainage holes in locking channel 20 near the junction of lateral wall 29 with bottom face 27.

In some embodiments, an adhesive can be used to attach objects, such as brick or tile, to the panel 10. For example, adhesive can be applied to a front face 52 and/or channel 20 of the panel 10, and an object 30 can then be attached to the panel 10. In some embodiments, the adhesive is applied to a limited width of the panel 10, for example, a relatively small amount of adhesive can be used per object 30 (for example, a width of the adhesive is substantially less than a span of the object 30). In some embodiments, the adhesive can fill an entire height of a channel 20, for example filling in a rear channel dimension 28 that exceeds a dimension of the channel opening 25, to provide a mechanical lock between the adhesive and channel 20. In some embodiments, grout can be used to fill gaps between objects 30.

Figure 5:
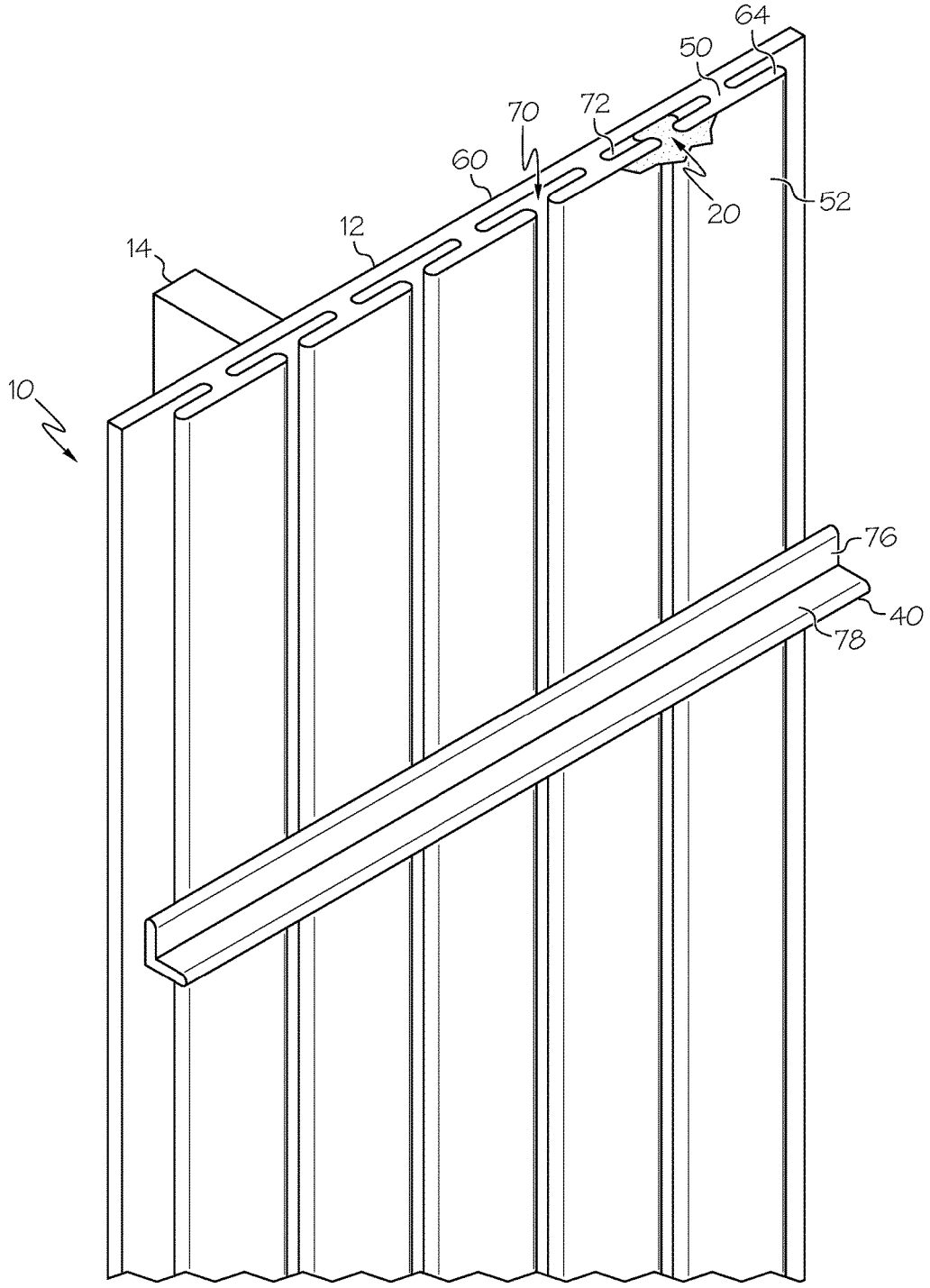
FIG. 5 shows another embodiment of a support panel.

FIG. 5 shows another embodiment of a support panel 10. In some embodiments, a support panel 10 comprises a base member 12 and at least one guide member 40. In some embodiments, a guide member 40 is separately attachable to a base member 12. In some embodiments, the base member 12 comprises markings at regular intervals to indicate predetermined positioning for one or more guide members 40.

In some embodiments, a support panel 10 comprises a continuous wall portion 60. In some embodiments, a continuous wall portion 60 is planar and extends across a full width and height of the support panel 10.

In some embodiments, a support panel 10 comprises a plurality of rails 50 that extend outward from a wall portion 60. In some embodiments, a rail 50 comprises a stem portion 62 in contact with the wall portion 60 and one or more flange portions 64. In some embodiments, the flange portions 64 are spaced apart from the wall portion 60 and define cavities 70 in the panel 10.

In some embodiments, a panel 10 is configured such that abutting multiple panels side-by-side will create a continuous repeating pattern of rails 50 and cavities 70.

In some embodiments, a cavity 70 comprises a locking channel 20, thereby providing the panel with a lath.

In some embodiments, a cavity 70 extends vertically and continuously from a first edge of the panel 10 to an opposite edge, and at least a portion of the cavity comprises a weep channel 72. As shown in FIG. 5, in some embodiments, a first portion of a cavity 70 can be filled with grout or mortar, while a second portion of a cavity comprises a weep channel 72. Desirably, the weep channel 72 extends continuously for a full height of the panel 10.

In some embodiments, the material of the panel 10 comprises a vapor barrier.

Thus, in some embodiments, a support panel 10 can be used in place of traditional sheathing, tar paper/vapor barrier, weep channel material and/or lath material. In some embodiments, a wall comprises structural supports, a panel attached to the structural supports, and objects attached to the panel, for example using mortar. In some embodiments, the wall excludes a separate sheathing layer. In some embodiments, the wall excludes a separate vapor barrier layer such as tar paper. In some embodiments, the wall excludes a separate weep channel defining material. In some embodiments, the wall excludes a separate lath member.

In some embodiments, a guide member 40 comprises a first portion 76 oriented at an angle to a second portion 78. The first portion 76 can be used to attach the guide member 10 to the base member 12 using any suitable method, such as fasteners, adhesive, etc.

A guide member 40 can be placed in any suitable orientation on a base member 12. A guide member 40 can comprise a guide for objects 30 attached to the panel 10, and can be arranged according to the desired pattern of objects (e.g. horizontal, vertical, diagonal and suitable combinations thereof.

Desirably, a plurality of guide members 40 provide for metering of mortar as described herein.

In some embodiments, a panel 10 comprises one or more guide members 40 having a first orientation, and at least one guide member 40 having a second orientation, wherein the first orientation is at a non-zero angle to the second orientation. For example, one or more first guide members 40 can be arranged horizontal while a second guide member is not horizontal, for example being vertical or diagonal. In some embodiments, a panel 10 comprises a plurality of first guide members and a plurality of second guide members non-parallel to the first guide members. In some embodiments, a panel 10 further comprises one or more third guide members, wherein each third guide member is oriented at a non-zero angle to a second guide member and is oriented at a non-zero angle to a first guide member.

In some embodiments, a panel 10 can be used to form a wall comprising objects 30 pressed in mortar as herein described, wherein the method of constructing the wall excludes a separate application of grout.

In some embodiments, the invention is directed to the following numbered paragraphs:

1. A method comprising:

providing a support panel comprising face portions and raised guide members, said guide members defining predetermined spaces;

providing a curable material and filling at least one of said predetermined spaces with said curable material, thus forming at least one curable material pan; and providing an object and pressing said object into said curable material pan.

2. The method of paragraph 1 above, comprising:

forming a plurality of curable material pans; and providing a plurality of objects and pressing each object into a curable material pan.

3. The method of paragraph 1 above, wherein each guide member is used to locate a plurality of said objects.

4. The method of paragraph 1 above, said panel comprising at least one cavity having a front opening, said method comprising:

filling a portion of said cavity with said curable material.

5. The method of paragraph 1 above, comprising:

providing an edge;

orienting said edge to contact a plurality of said guide members and forming said at least one curable material pan by skimming off excess curable material.

6. The method of paragraph 1 above, wherein providing said support panel comprises:

providing a base member comprising said face portions;

providing a plurality of guide members; and attaching said guide members to said base member.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternative embodiments of the invention. Those skilled in the art may recognize other equivalents to the specific embodiment described herein which equivalents are intended to be encompassed by the claims attached hereto. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A method comprising:

providing a support panel comprising face portions and a plurality of raised guide members, each guide member comprising a front edge, the face portions aligned on a first plane, the front edges aligned on a second plane, the support panel defining predetermined spaces between guide members, the support panel comprising a single piece of material;

attaching the support panel to a supporting surface to form a vertically oriented support panel;

forming a curable material pan by filling at least one of the predetermined spaces of the vertically oriented support panel with a curable material, wherein a surface of the curable material is aligned with the front edge of at least one guide member; and embedding an object into the curable material by aligning the object using one of the guide members and pressing the object into the curable material pan so that the curable material extends past the guide member front edge, the curable material pan retaining the object in a vertical orientation.

2. The method of claim 1 comprising:

forming a plurality of curable material pans; and providing a plurality of objects and pressing each object into a curable material pan.

3. The method of claim 1, wherein each guide member is used to locate a plurality of said objects.

4. The method of claim 1, the support panel comprising at least one cavity extending behind the face portions.

5. The method of claim 4, wherein forming the curable material pan comprises filling at least a portion of the cavity with the curable material.

6. The method of claim 4, wherein a distance across the cavity is greater than a distance across an opening into the cavity.

7. The method of claim 6, wherein the opening into the cavity is aligned with the face portions.

8. The method of claim 1, wherein forming the curable material pan comprises:

providing a tool comprising an edge;

filling the predetermined space with the curable material such that the curable material extends beyond the front edge of a guide member; and orienting the edge to contact at least one guide member and skimming off excess curable material.

9. The method of claim 1, wherein the guide members are parallel with one another.

10. The method of claim 9, the support panel comprising at least three guide members, wherein the guide members are equally spaced.

11. The method of claim 1, comprising using fasteners to attach the support panel to the supporting surface.

12. The method of claim 1, wherein curable material displaced from the curable material pan when the object is embedded forms a bed joint between adjacent objects.

13. The method of claim 12, wherein the bed joint extends outward beyond a front surface of the object.

14. The method of claim 13, comprising removing a portion of the bed joint that extends outward beyond the front surface of the object.

15. The method of claim 1, wherein providing the support panel comprises:

providing a base member comprising the face portions;

providing a plurality of guide members; and attaching the guide members to the base member.

16. The method of claim 1, wherein a depth of the guide members is less than a thickness of the object.

17. The method of claim 1, the support panel comprising a first support panel comprising an edge defining a recess, the method comprising providing a second support panel comprising an edge comprising a protrusion and placing the second support panel adjacent to the first support panel with the protrusion oriented in the recess.

18. A method comprising:

providing a support panel comprising a single piece of material, the support panel comprising at least three face portions and at least three raised guide members, each guide member extending from one of the face portions, said guide members defining predetermined spaces;

attaching the support panel to a supporting surface to form a vertically oriented support panel;

applying a curable material to the vertically oriented support panel comprising filling at least one of said predetermined spaces with said curable material, thus forming at least one curable material pan; and providing an object and pressing said object into said curable material pan so that the curable material extends past the guide member front edge, wherein said curable material pan retains said object in a vertical orientation.

19. A method comprising:

providing a support panel comprising a first end and an opposed second end, a first face portion, a second face portion and a third face portion spaced between the first end and the second end, a first guide member extending outward from the first face portion, a second guide member extending outward from the second face portion and a third guide member extending outward from the third face portion, each of said guide members comprising a front edge, the face portions aligned on a first plane, the front edges aligned on a second plane, a first predetermined space defined between the first guide member and the second guide member, a second predetermined space defined between the second guide member and the third guide member, the support panel comprising a single piece of material;

attaching the support panel to a supporting surface to form a vertically oriented support panel;

forming a first curable material pan by filling the first predetermined space of the vertically oriented support panel with a curable material and forming a second curable material pan by filling the second predetermined space of the vertically oriented support panel with the curable material, wherein a surface of the first curable material pan is aligned with the front edge of the first guide member and a surface of the second curable material pan is aligned with the front edge of the second guide member;

embedding a first object into the first curable material pan by aligning the first object upon the first guide member and pressing the first object into the first curable material pan so that the curable material extends past the guide member front edge, wherein the first curable material pan retains the first object in a vertical orientation, and embedding a second object into the second curable material pan by aligning the second object upon the second guide member and pressing the second object into the second curable material pan so that the curable material extends past the guide member front edge, wherein the second curable material pan retains the second object in a vertical orientation.

* * * * *